United States Patent [19]

Absher

[11] 4,131,994

[45] Jan. 2, 1979

[54] HAND TOOL

[76] Inventor: John W. Absher, 9710 Laird Ave., Cleveland, Ohio 44102

[21] Appl. No.: 858,679

[22] Filed: Dec. 8, 1977

[51] Int. Cl.[2] ..... B26B 11/00

[52] U.S. Cl. ..... 30/148

[58] Field of Search ..... 30/124, 142, 148, 322; 294/61; 128/305

[56] References Cited

U.S. PATENT DOCUMENTS

| | | | |
|---|---|---|---|
| 57,918 | 9/1866 | Jennings | 30/148 |
| 546,376 | 9/1895 | Barry et al. | 30/148 |
| 1,324,565 | 12/1919 | Przybylek | 30/148 |
| 1,585,533 | 5/1926 | Coursen et al. | 30/148 |
| 3,376,640 | 4/1968 | Kramer et al. | 30/148 |
| 3,405,445 | 10/1968 | Canion | 30/148 |

*Primary Examiner*—Jimmy C. Peters

[57] ABSTRACT

A hand tool particularly useful as an eating utensil having a handle, a pivotally mounted skewer attached to one end of the handle, a swivel block attached to the end of the handle opposite the skewer and a rotatably mounted utility shaft attached to the swivel block. The utility shaft terminates in a utensil such as a knife blade. The device is particularly useful to persons handicapped by the loss of one hand or arm whereby they can both hold and cut a piece of material with one hand.

13 Claims, 8 Drawing Figures

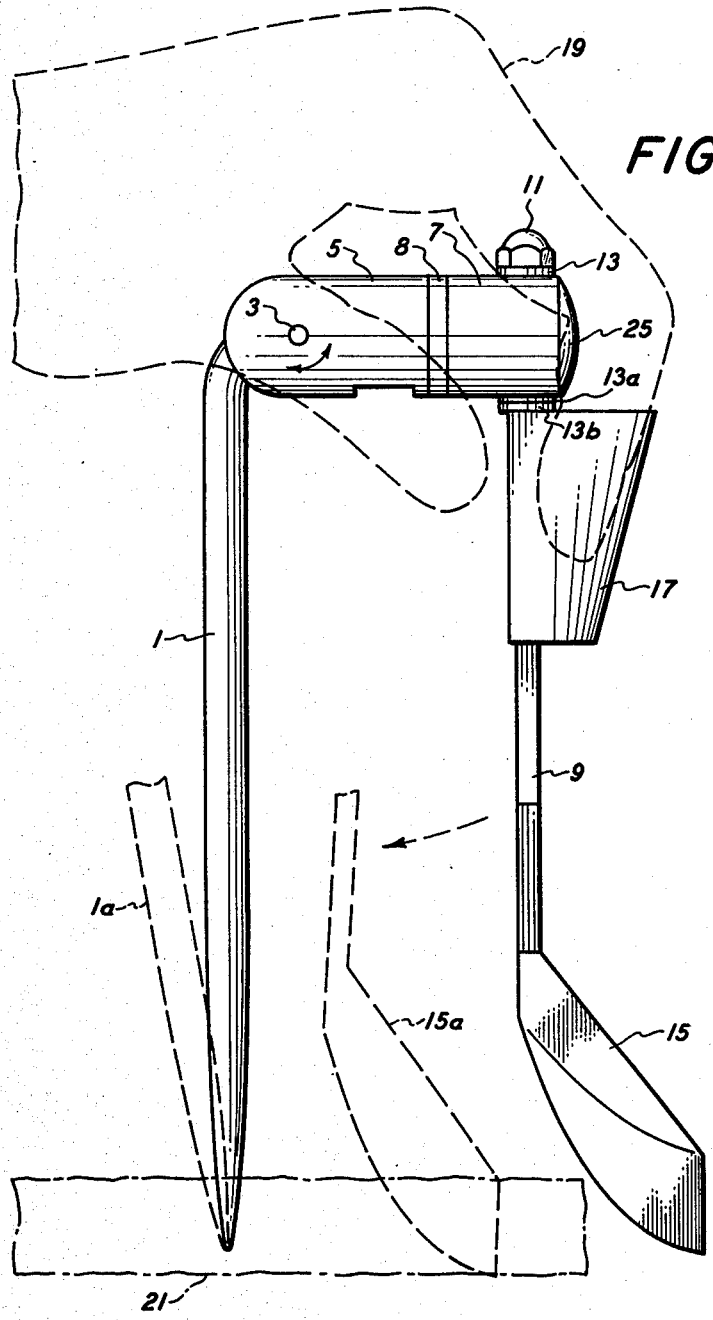
FIG. 1
FIG. 2
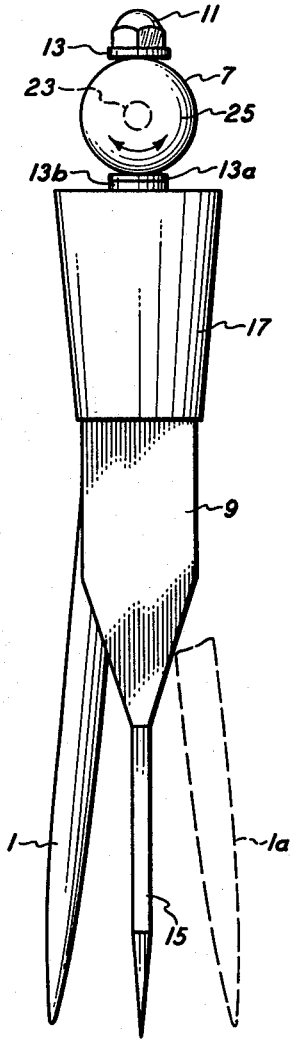
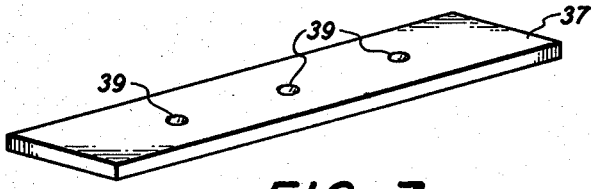
FIG. 7

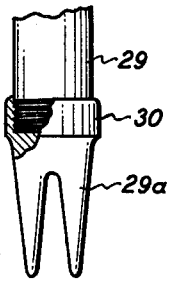
FIG. 6A
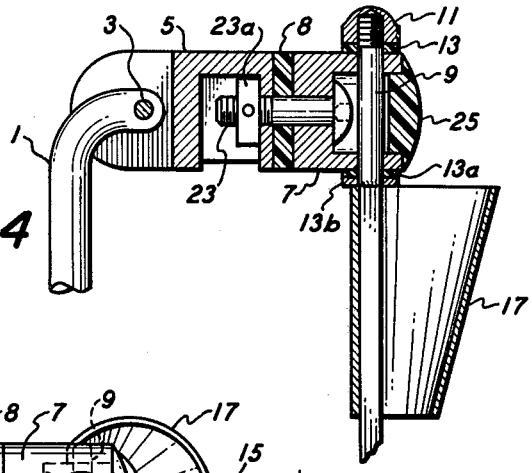
FIG. 4
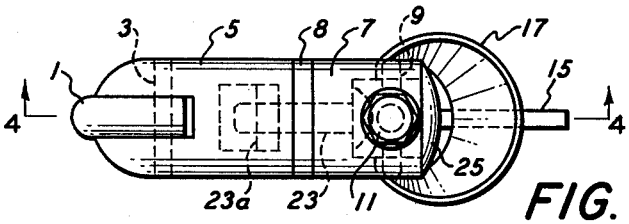
FIG. 3
FIG. 6
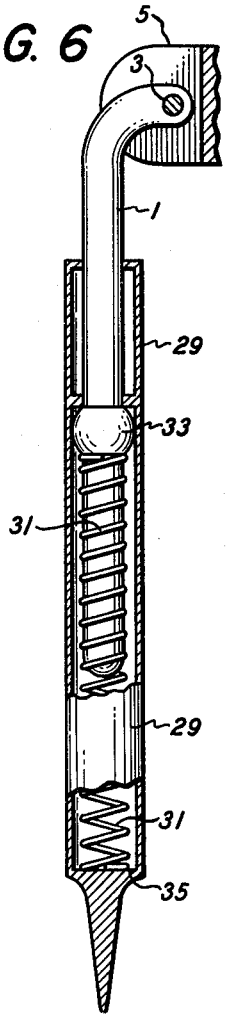
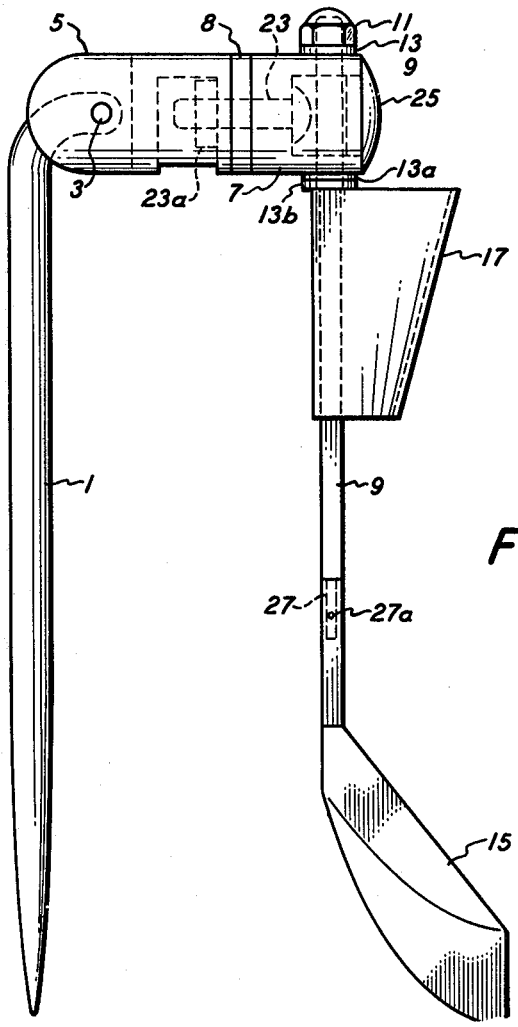
FIG. 5

HAND TOOL

BACKGROUND OF THE INVENTION

This invention relates to a hand tool and more specifically to a utensil particularly useful to a person having the use of only one hand.

Eating utensils such as knives and forks of common design are unsuitable in many instances for persons who have suffered the loss of or are unable to use one arm or hand. The operation of such common devices which seem effortless to the unhandicapped present an unsurmountable problem when placed in the hands of a person having the use of only one hand or wherein the hand available is unsteady or under poor control of the person.

There is a great need for a utensil which enables a person having the use of only one hand to independently perform normal table operations involved with the use of flat ware such as table knives.

Previously known devices are cumbersome for use at a dining table or do not provide the required flexibility for cutting food on a plate in the usual eating environment. A typical device for cutting material with one hand provides support for the cutting instrument from a stand attached to a table rather than relying on support from the hand. One such prior art device is disclosed in U.S. Pat. No. 1,830,688 to Bach.

It is, therefore, an object of this invention to provide a device for use as both a holder and cutting device for material.

Another object of this invention is to enable a person handicapped by the loss of an arm or hand to become more independent in the normal eating operation.

Another object of this invention is to provide a multipurpose handle having detachable tools.

Yet another object of this invention is to provide an accurate and guided cutting device which will both hold and cut the material along a predetermined path.

BRIEF DESCRIPTION OF THE INVENTION

The present invention is described with reference to the attached drawings wherein:

FIG. 1 is a right-side elevation of the cutting device of this invention showing how the device is held in the hand.

FIG. 2 is a front elevation of the cutting device of this invention indicating pivotal movement of the blade.

FIG. 3 is a top view of the device of this invention.

FIG. 4 is a side sectional view through section A—A of FIG. 3.

FIG. 5 is a view of the left-side elevation of the device of this invention.

FIG. 6 is a left-side elevation view, in partial section, of a preferred embodiment of this invention.

FIG. 6A is a side elevation in partial section of an optional embodiment of the skewer portion of the device of this invention.

FIG. 7 is a perspective view of a guide plate of this invention.

DETAILED DESCRIPTION OF THE INVENTION

In FIG. 1 there is shown a right-side elevation of the cutting device of this invention including a dashed-line indication of a second position obtained by operation of the device. The cutting device is supported by skewer 1 during the cutting operation. Skewer 1 is pivotally mounted on pin 3 in handle 5. As will be more fully described below, there is attached to handle 5 swivel block 7. Preferably, a low friction washer 8 is provided between handle 5 and swivel block 7. Rotatably mounted to swivel block 7 is utility shaft 9 which is positioned through a hole, not shown, in swivel block 7. Utility shaft 9 is typically affixed to swivel block 7 by means of self-locking nut 11 which joins a threaded end of shaft 9. Preferably, low friction washers 13, 13*a* and 13*b* provide for improved rotational movement of shaft 9. Knife blade 15 is rigidly fixed to or integral with utility shaft 9.

Also mounted on shaft 9 is optional finger guide 17 which enables the operator to guide the direction of knife blade 15 by placing pressure against shaft 9. Upward movement of knife blade 15 is achieved by movement of the finger in finger guide 17. Finger guide 17 can take any suitable form such as is shown. One example of an alternative form is a ring or rings through which a finger or fingers may extend.

In operation, the hand exerts downward pressure on handle 5 thereby applying force to skewer 1 which, in FIG. 1, is shown to pierce and hold material 21 in place. By combining rearward force by the hand together with downward pressure, the device is caused to move into the position indicated by the dashed lines. Skewer 1 assumes the position 1*a* by pivotal movement at pin 3. Knife blade 15 is moved to position 15*a* and is guided by the index finger of the hand, although any suitable finger of the hand can be employed. This movement draws the knife through the material 21 thereby cutting the material.

FIG. 2 discloses the front elevation of the device and illustrates the motion of swivel block 7. To provide full control, in the use of one hand, swivel block 7 rotates as indicated by the double-headed arrow. Thus, the direction of utility shaft 9 and thus knife blade 15 is directed by the finger inserted into the finger guide 17. The finger can exert pressure not only in the vertical plane but also in the horizontal plane thereby moving knife blade 15 out of alignment with skewer 1. As shown in FIG. 2, shaft 9 and knife blade 15 can operate out of alignment with skewer 1 which is shown in alternative position 1*a*.

FIGS. 3 and 4 illustrate in greater detail the combination of the handle with the operative portions of the device.

In FIG. 3, there is shown skewer 1 affixed to handle 5 through pin 3. Preferably, pin 3 is a spring tension pin which achieves stability of the device while allowing easy movement during operation. Swivel block 7 is shown fastened to handle 5 by means of bolt 23 and nut 23*a*. The other components are indicated by numerals as defined above.

FIG. 4 is a sectional view along the lines A—A of FIG. 3. In FIG. 4, handle 5 is shown having a cavity in which bolt 23 resides and is held by self-locking nut 23*a*. Washer 8 separates swivel block 7 from handle 5 and is preferably comprised of an inert, low friction type material. Typical examples of such materials include polymeric materials, such as polypropylene and polyethylene. Preferable other inert materials are sold under such trade names as Mylar and Teflon. The head of bolt 23 resides in a chamber in swivel block 7 formed by flanges. Cap 25 closes the chamber for purposes of cleanliness as well as aesthetic value. Washers 13, 13*a* and 13*b* are preferably comprised of low friction polymeric materials as described above which enables the device to attain firm stability as well as easy movement when in use.

In operation, swivel block 7 rotates around bolt 23 riding against washer 8 which may be fixed or allowed to rotate. Suitable adjustment of tension is obtained by tightening bolt 23 whereby the device achieves the combination of stability and easily guided movement during operation.

FIG. 5 illustrates the left-side elevational view of the device of this invention. Also illustrated in this figure is another feature of utility of the device. All reference numerals of FIG. 5 common with FIG. 1 are defined the same as in FIG. 1. Utility shaft 9, in FIG. 5, contains a squared shank 27 on the end towards knife blade 15. In this embodiment, knife blade 15 is formed of a separate section having a cavity sized to fit over shank 27 in such fashion that it is held in place on utility shaft 9. One means for securing knife blade 15 onto shaft 9 is a spring loaded ball 27*a* which matches a depression in knife blade 15. Any suitable means to secure knife blade 15 to shaft 9 may be employed.

The embodiment of FIG. 5 is preferred because it allows the blade to be removed from the device for many reasons. For example, the blades may be replaced when it becomes dulled through use or perhaps damaged accidently in some way. Also, the cleaning operation may be facilitated by removal of the knife blade 15 from shaft 9. Yet another valuable variation in the device of this invention is the capability of interchanging different styles of blades for different purposes such as cutting meat, vegetables or even the length of blade may be changed. Also different utensils may be adapted to shaft 9. Thus, a potato masher having a flat surface may be easily installed in place of the knife blade 15. Alternatively, a fork may be installed. Other useful devices may be installed on shaft 9 for various purposes unrelated to food or eating to give advantage to the person desiring to utilize one hand to perform tasks otherwise more difficult without the stability provided by skewer 1 and the flexibility provided by handle 5.

Referring now to FIG. 6, there is shown a preferred skewer for use in the device of this invention. In FIG. 6, skewer 1 is shown terminating in housing 29, said housing shown in partial section. Housing 29 enclosed spring 31 with a close clearance to prevent the spring from buckling within the housing. The housing is closed around skewer 1 at the upper end so as to allow for a sliding motion between housing 29 and skewer 1. A split upper section of housing 29 can be utilized with a suitable clamp to enclose block 33 attached to skewer 1. Housing 29 contains a blunt point terminus at the lower end which performs the function of skewer 1 in FIG. 1.

In use, spring 31 compresses between block 33 and ledge 35 upon exertion of downward pressure applied to handle 5. Block 33 is also sized within housing 29 to permit movement of block 33 easily when compressing spring 31. While not intended to be limited by any particular dimension, the usual desirable distance of travel of skewer 1 by compression of spring 31 is about 2 inches. Such length of travel is typical wherein the total length from handle 5 to the blunt point of housing 29 is about 8 inches. Thus, the amount of space provided between the uppermost portion of housing 29 and handle 5 is at least the desired distance of travel upon compression of spring 31.

One advantage of the preferred embodiment of this invention, as shown in FIG. 6, is the capability of keeping handle 5 level during use although the device of this invention is fully operable when handle 5 is not utilized in a level position with respect to the material being acted upon by the utensil attached to or made a part of shaft 9. For example, referring to FIG. 1, one can see that, should skewer 1 not completely pierce material 21, handle 5 will not be held level with material 21 when knife blade 15 cuts completely through material 21. Experience has indicated that greater convenience is obtained when utilizing the embodiment of FIG. 6 when cutting material such as meat.

Another alternative embodiment of skewer 1 is illustrated in FIG. 6A. In this embodiment of skewer 1, housing 29 terminates in a fitting which receives detachable end piece 29*a*. In this exemplary illustration, FIG. 6A shows end piece 29*a* attached to skewer housing 29 by means of a threaded fitting 30. By means of a detachable end piece, the length of skewer 29 may be extended. Thus, end piece 29*a* is shown as being variable in length. This embodiment is particularly useful wherein the optional utility shaft has a detachable blade or tool which thus varies the total length between the upper end of utility shaft 9 and the bottom of blade or tool 15.

Also, skewer 1, without housing 29 is conveniently modified so as to terminate in a fitting which receives a detachable end piece thus providing the advantages described herein with respect to FIG. 6A to the embodiment of FIG. 1. Thus, skewer 1 of FIG. 1 can alternatively terminate without a taper and be provided with a fitting as described with respect to housing 29 of FIG. 6A.

Another advantage of utilizing the optional embodiment of FIG. 6A is the ability to modify the lower end of skewer 1. Thus, end piece 29*a* may have any desired configuration such as multiple points, as shown, rather than one. In addition, skewer 1 may be modified so as to fit into any fixture especially adapted to perform a specific purpose such as the guide hereinbelow described and exemplified by FIG. 7.

In yet another embodiment, an auxiliary device has been found to give advantage in cutting soft materials such as bread and, in particular, the usual sandwich containing bread. The auxiliary device is in the form of a plate containing slight indentations adapted to fit the blunt end of skewer 1 or housing 29. The auxiliary device is, in FIG. 7, plate 37 containing indentations 39. Plate 37 can take any desired shape or form and is utilized by placing the plate 37 on top of the material to be cut and placing the blunt end of skewer 1 or housing 29 into one of the indentations. Plate 37 stabilizes the device of this invention, particularly on soft surfaces.

Plate 37 can also act as a guide for knife blade 15 during a cutting operation. Thus, as mentioned above, plate 37 can take any shape or form to allow the user to cut a particular pattern in the material to be cut by following the edge of plate 37. In most instances, a rectangular plate as shown in FIG. 7 is desired, but plates having a curved or irregular shape can also be employed. If desired, the cutting operation can be interrupted so that skewer 1 or housing 29 can be lifted out of one indentation and placed in another more convenient with respect to the position of knife blade 15.

Although specific components and proportions have been stated in the above description of preferred embodiments of the invention, or typical materials, if suitable, may be used with similar results, it is to be understood that the invention is not to be limited to the exact details of operation or exact embodiments shown and described above. Obvious modifications and equivalents will be apparent to one of ordinary skill in the art, and the invention is therefore to be limited only by the scope of the appendent claims. What is claimed is:

1. A device comprising, in combination, a handle, a skewer means pivotally mounted on said handle; a swivel block attached to said handle at the opposite end from said skewer, a utility shaft rotatably mounted on said swivel block.

2. A device of claim 1 wherein said utility shaft is continuous and includes a knife blade at its open end.

3. The device of claim 1 wherein said skewer is enclosed in a housing and further including a spring surrounding said skewer within said housing, said spring being compressible between a block on said skewer and a ledge on said housing, said housing having a point at its open end.

4. The device of claim 1 wherein the utility shaft is adaptable to interchangeable utensils at its open end.

5. The device of claim 1 wherein said utility shaft contains a squared shank at its open end having a spring loaded ball to receive a utensil.

6. The device of claim 1 wherein a low friction washer is included between said handle and said swivel block.

7. The device of claim 1 in combination with a plate containing indentations adapted to receive said skewer.

8. The device of claim 3 in combination with a plate containing indentations adapted to receive said housing.

9. The device of claim 1 wherein said skewer is attached to said handle by means of a spring tension device.

10. The device of claim 3 wherein said skewer is attached to said handle by means of a spring tension device.

11. The device of claim 1 wherein said utility shaft supports a finger guide.

12. The device of claim 1 wherein said skewer is provided with a detachable end piece.

13. The device of claim 3 wherein said skewer housing is provided with a detachable end piece.

* * * * *